United States Patent [19]

Beck

[11] 4,429,748

[45] Feb. 7, 1984

[54] LOW PRESSURE RESPONSIVE APR TESTER VALVE

[75] Inventor: Harold K. Beck, Duncan, Okla.

[73] Assignee: Halliburton Company, Duncan, Okla.

[21] Appl. No.: 361,303

[22] Filed: Mar. 24, 1982

Related U.S. Application Data

[63] Continuation-in-part of Ser. No. 204,100, Nov. 5, 1980.

[51] Int. Cl.[3] ..... E21B 43/00

[52] U.S. Cl. ..... 166/324; 166/323

[58] Field of Search ..... 166/374, 321, 264, 324, 166/323

[56] References Cited

U.S. PATENT DOCUMENTS

| | | | |
|---|---|---|---|
| 3,323,550 | 6/1967 | Lee | 138/39 |
| 3,584,684 | 6/1971 | Anderson et al. | 166/129 |
| 3,664,415 | 5/1972 | Wray et al. | 166/0.5 |
| 3,814,182 | 6/1974 | Giroux | 166/266 |
| 3,856,085 | 12/1974 | Holden et al. | 166/264 |
| 3,858,649 | 1/1975 | Wray et al. | 166/162 |
| 3,860,009 | 1/1975 | Wray et al. | 166/264 |
| 3,889,751 | 6/1975 | Peters | 166/323 |
| 3,976,136 | 12/1976 | Farley et al. | 166/264 |
| 4,073,409 | 4/1978 | Barrington | 166/320 |
| 4,113,012 | 9/1978 | Evans et al. | 166/264 |
| 4,160,484 | 7/1979 | Watkins | 166/323 |
| 4,252,143 | 2/1981 | Fudd | 166/323 |

*Primary Examiner*—William F. Pate, III

*Attorney, Agent, or Firm*—James R. Duzan; Thomas R. Weaver

[57] ABSTRACT

An annulus pressure responsive tester valve including a pressure assisted isolation valve which includes a pressure differential metering cartridge to control the rate at which the isolation valve returns to the fluid pressure in the annulus between the wellbore and testing string thereby continuously controlling the rate of expansion the inert gas within the gas chamber and the attendant operation of the tester valve regardless of any temperature effect by cold fluids pumped therethrough.

11 Claims, 8 Drawing Figures

LOW PRESSURE RESPONSIVE APR TESTER VALVE

BACKGROUND OF THE INVENTION

This application is a continuation-in-part of U.S. patent application Ser. No. 204,100, filed Nov. 5, 1980.

This invention relates to an improved annulus pressure responsive tester valve for use in oil and gas wells. This invention is particularly useful in the testing of offshore wells where it is desirable to conduct testing operations and well stimulation operations utilizing the testing string tools with a minimum of testing string manipulation, and preferably with the blowout preventers closed during most operations.

It is known in the art that tester valves and sampler valves for use in oil and gas wells may be operated by applying pressure increases to the fluid in the annulus between the wellbore and testing string therein of a well. For instance U.S. Pat. No. 3,664,415 to Wray et al discloses a sampler valve which is operated by applying annulus pressure increases against a piston in opposition to a predetermined charge of inert gas. When the annulus pressure overcomes the gas pressure, the piston moves to open a sampler valve thereby allowing formation fluid to flow into a sample chamber contained within the tool, and into the testing string facilitating production measurements and testing.

In U.S. Pat. No. 3,858,649 to Holden et al a tester valve is described which is opened and closed by applying pressure changes as to the fluid in the annulus contained between the wellbore and testing string therein of a well. The tester valve contains a supplementing means wherein the inert gas pressure is supplemented by the hydrostatic pressure of the fluid in the annulus contained between the wellbore and testing string therein as the testing string is lowered into the well. This feature allows the use of lower inert gas pressure at the surface and provides that the gas pressure will automatically be adjusted in accordance with the hydrostatic pressure and environment at the testing depth, thereby avoiding complicated gas pressure calculations required by earlier devices for proper operation. The tester valve described in U.S. Pat. No. 3,856,085 to Holden et al likewise provides a supplementing means for the inert gas pressure in a full opening testing apparatus.

This supplementing means includes a floating piston exposed on one side to the inert gas pressure and on the other side to the annulus fluid pressure in order that the annulus fluid pressure can act on the inert gas pressure. The system is balanced to hold the valve in its normal position until the testing depth is reached. Upon reaching the testing depth, the floating piston is isolated from the annulus fluid pressure so that subsequent changes in the annulus pressure will operate the particular valve concerned.

This method of isolating the floating piston has been to close the flow channel from the annulus contained between the wellbore and testing string in a well to the floating piston with a valve which closes upon the addition of weight to the testing string. This is done by setting the testing string down on a packer which supports the testing string and isolates the formation in the well which is to be tested during the test. The apparatus, which is utilized to isolate the floating piston is designed to prevent the isolation valve from closing prematurely due to increasingly higher pressures as the testing string is lowered into the well, contains means to transmit the motion necessary to actuate the packer and is designed to remain open until sufficient weight is set down on the packer to prevent premature isolation of the gas pressure and thus premature operation of the tester valve.

However, since the tester valve described in U.S. Pat. No. 3,856,085 contains a weight operated tester valve, the tester valve may inadvertently open when being run into the well on a testing string, if a bridge is encountered in the wellbore thereby allowing the weight of the testing string to be supported by the tester valve. Also, in this connection, in highly deviated wellbores it may not be possible to apply sufficient weight to the testing string to actuate the isolation valve portion of the tester valve thereby causing the tester valve to be inoperable. Furthermore, if it is desired to utilize a slip joint in the testing string, unless weight is constantly applied to the slip joint to collapse the same, the isolation valve portion of the tester valve will open thereby causing the tester valve to close.

In U.S. Pat. No. 3,976,136 to Farley et al a tester valve is described which is opened and closed by applying pressure changes to the fluid in the annulus contained between the wellbore and testing string therein of a well and which contains a supplementing means wherein the inert gas pressure is supplemented by the hydrostatic pressure of the fluid in the annulus contained between the wellbore and testing string therein as the testing string is lowered into the well. This tester valve utilizes a method for isolating the gas pressure from the annulus fluid pressure which is responsive to an increase in the annulus fluid pressure above a reference pressure wherein the operating force of the tool is supplied by the pressure of a gas in an inert gas chamber in the tool. The reference pressure used is the pressure which is present in the annulus at the time a wellbore sealing packet is set to isolate one portion of the wellbore from another.

The annulus fluid pressure is allowed to communicate with the interior bore of this tester valve as the testing string is lowered in the wellbore and is trapped as the reference pressure when the packer seals off the wellbore thereby isolating the formation in the well which is to be tested. Subsequent increases in the well annulus pressure above the reference pressure activates a pressure response valve to isolate the inert gas pressure from the well annulus fluid pressure. Additional pressure increases in the well annulus causes the tester valve to operate in the conventional manner.

Once a well has been tested to determine the contents of the various formations therein, it may be necessary to stimulate the various formations to increase their production of formation fluids. Common ways of stimulating formations involve pumping acid into the formations to increase the formation permeability or hydraulic fracturing of the formation to increase the permeability thereof or both.

After the testing of a well, in many instances, it is highly desirable to leave the testing string in place in the well and stimulate the various formations of the well by pumping acids and other fluids into the formations through the testing string to avoid unnecessary delay by pulling the testing string and substituting therefore a tubing string.

During well stimulation operations in locations during extremely cold environmental periods where the tester valves described in U.S. Pat. Nos. 3,856,085 and 3,976,136 are utilized in the testing string if large volumes of cold fluids are pumped through the tester valves, even though the formations surrounding the tester valves may have a temperature of several hundred degrees fahrenheit, the tester valve will be cooled to a temperature substantially lower than the surrounding formations by the cold fluids being pumped therethrough. When these tester valves are cooled by the cold fluids, the inert gas in the valves contracts. Upon the cessation of the pumping of cold fluids through the tester valve, if it is desired to close the test valve by releasing the fluid pressure in the annulus between the wellbore and testing string, since the inert gas has contracted due to the cooling of the valve, the inert gas in its cooled state may not exert sufficient force to close the tester valve to thereby isolate the formation which has been stimulated from the remainder of the testing string. If this condition occurs, it will be necessary to maintain the fluid pressure in the testing string at the surface thereof and wait for the formation to warm the tester valve until the inert gas expands sufficiently to regain the pressure level required to close the tester valve when the fluid pressure in the annulus between the wellbore and testing string is released. Since this warming of the inert gas can require a lengthy period of time during which the flow from the formation cannot be controlled by the tester valve, an undesirable condition which affects control of the well exists.

While it is theoretically possible to charge the inert gas chambers of the tester valves at the surface to compensate for the cooling effect of pumping cold fluids through the tester valves, if the cooling effect can be ascertained, this would cause the pressure levels of the fluid in the annulus between the wellbore and testing string to be unacceptable when the tester valve is at the temperature of the surrounding formation thereby risking damage to the testing string. Furthermore, in actual practice, compensating for the cooling effect of the tester valve by overcharging of the inert gas chamber at the surface, cannot be accomplished in most instances because the precise cooling effect cannot be easily ascertained due to the unknown heat transfer characteristics of the fluid being pumped through the testing string and the surrounding formations.

STATEMENT OF THE INVENTION

In contrast to the prior art, the annulus pressure responsive tester valve of the present invention includes a pressure assisted isolation valve which includes a pressure differential metering cartridge to control the rate at which the isolation valve returns to the fluid pressure in the annulus between the wellbore and testing string thereby continuously controlling the rate of expansion the inert gas within the gas chamber and the attendant operation of the tester valve regardless of any cooling effect by cold fluids pumped therethrough. The tester valve of the present invention embodies improvements over the prior art valves described in U.S. Pat. Nos. 3,856,085 and 3,976,136 to eliminate undesirable operating characteristics thereby by including a pressure differential metering cartridge which is similar to that described in U.S. Pat. No. 4,113,012 as well as a resilient means to positively control the opening and closing of the tester valve to prevent erosion of the valve member due to high fluid velocities therethrough.

BRIEF DESCRIPTION OF THE DRAWINGS

The advantages of the present invention will be more fully understood from the following description and drawings wherein.

FIGS. *2a–2g* joined along section lines a—a through g—g illustrate the present invention in cross-section.

DESCRIPTION OF THE INVENTION

Figure 1:
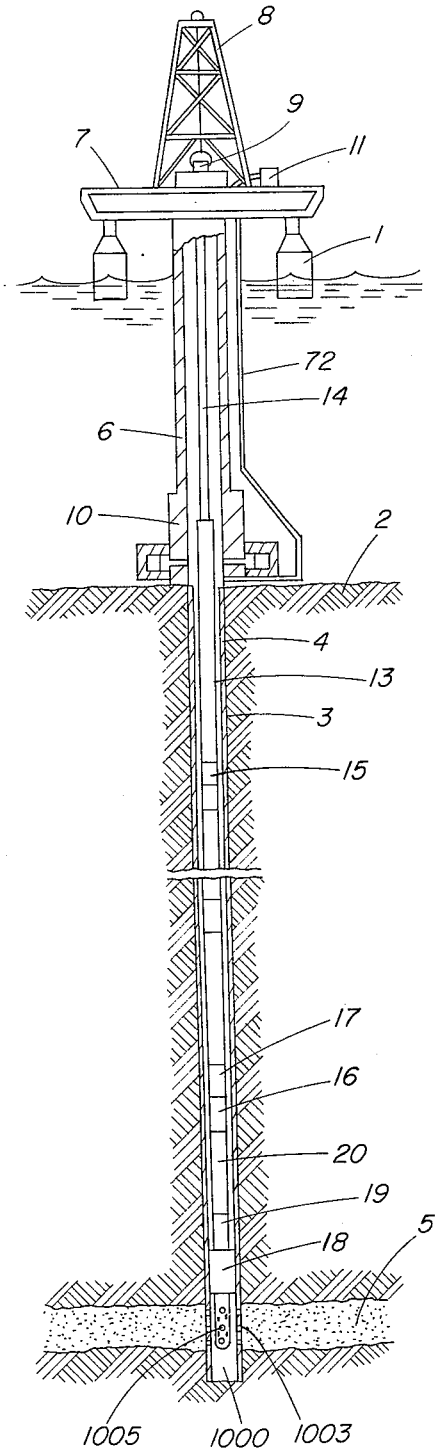
FIG. 1 provides a schematic "vertically sectioned" view of a representative offshore installation which may be employed for testing purposes and illustrates a formation testing "string" or tool assembly in position in a submerged wellbore and extending upwardly to a floating operating and testing station.
Figure 2A:
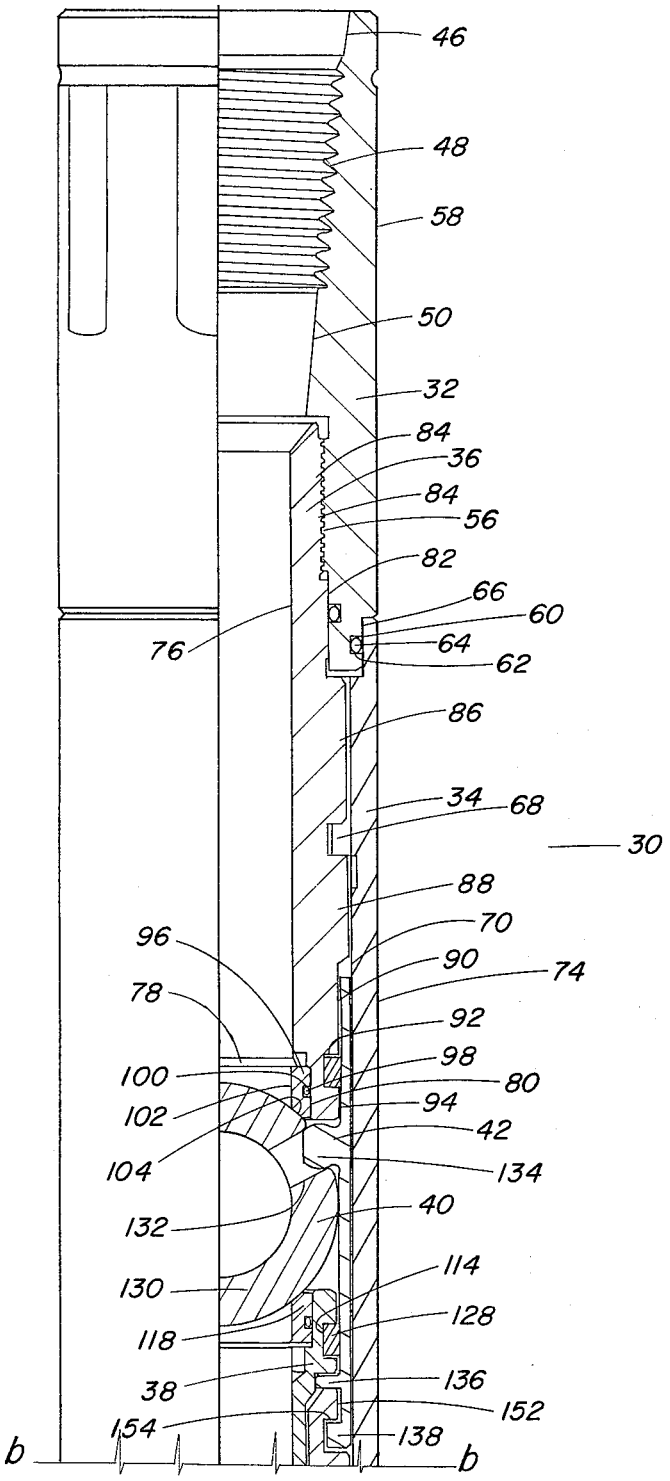
Figure 2B:
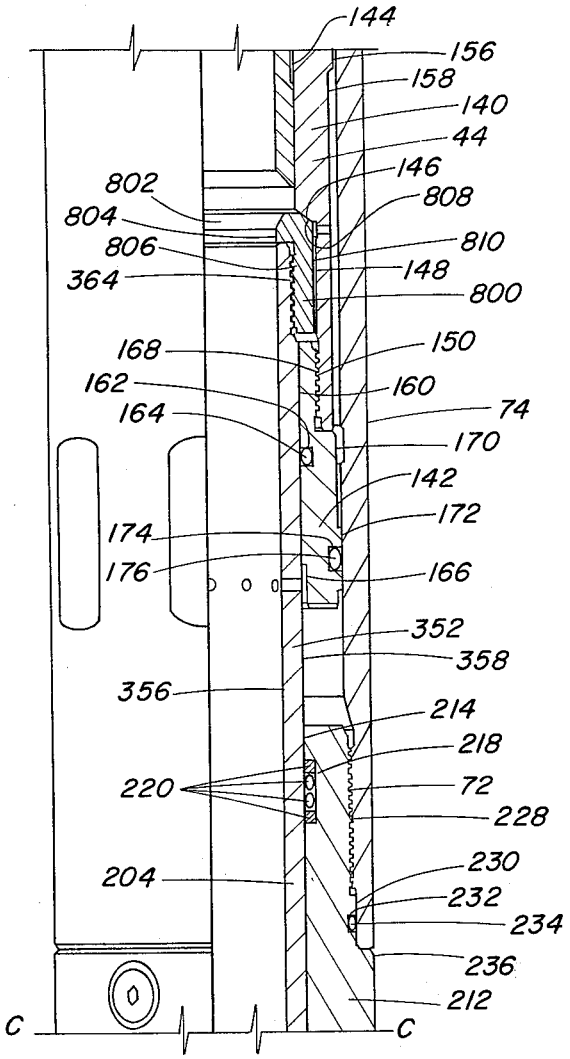
Figure 2C:
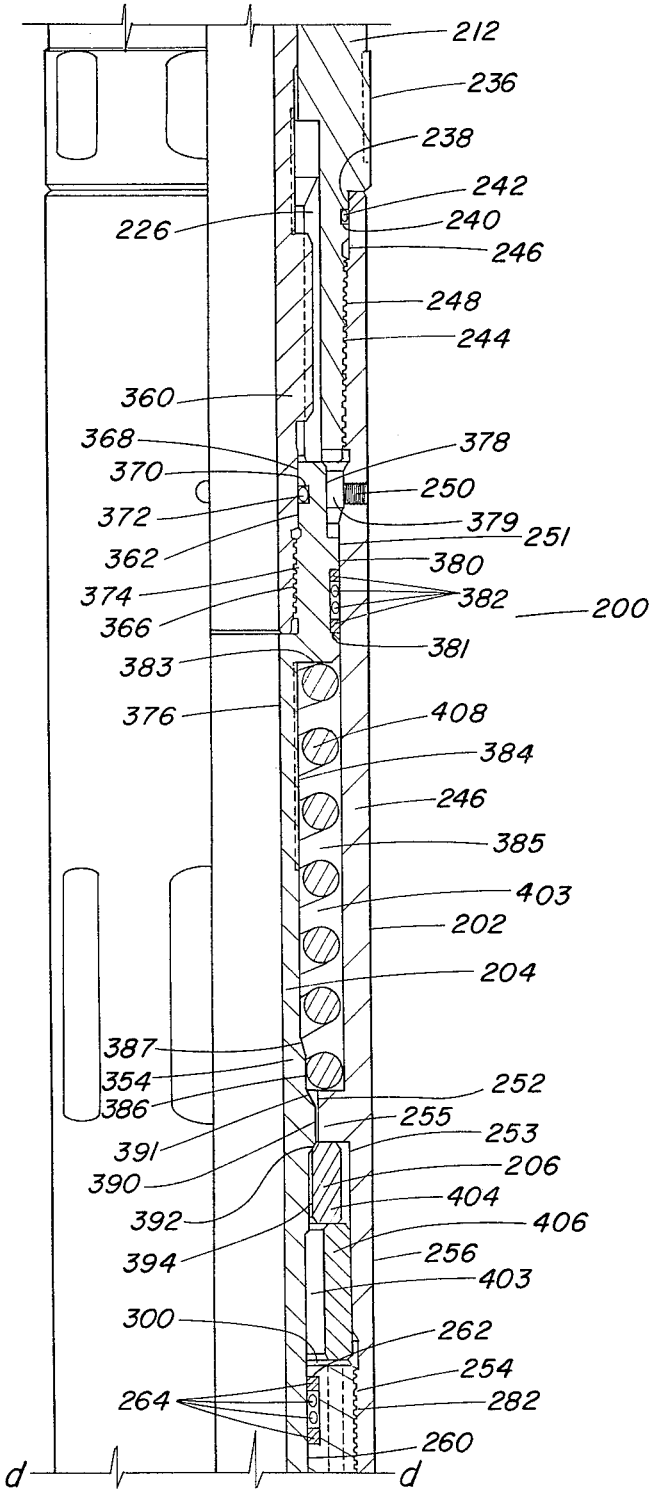
Figure 2D:
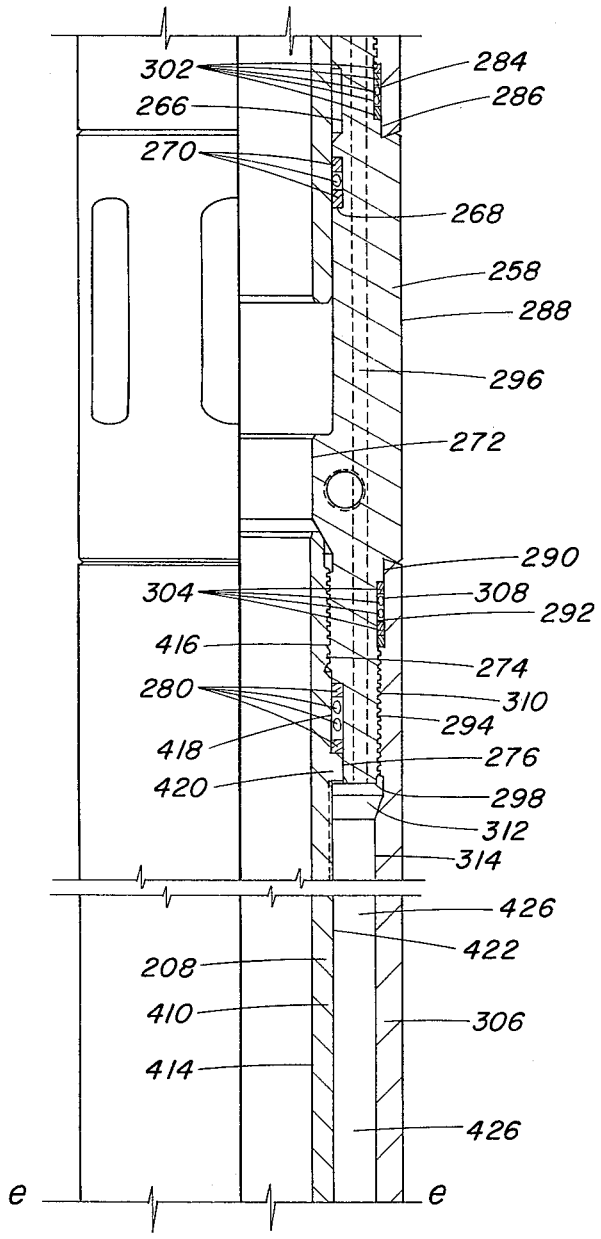
Figure 2E:
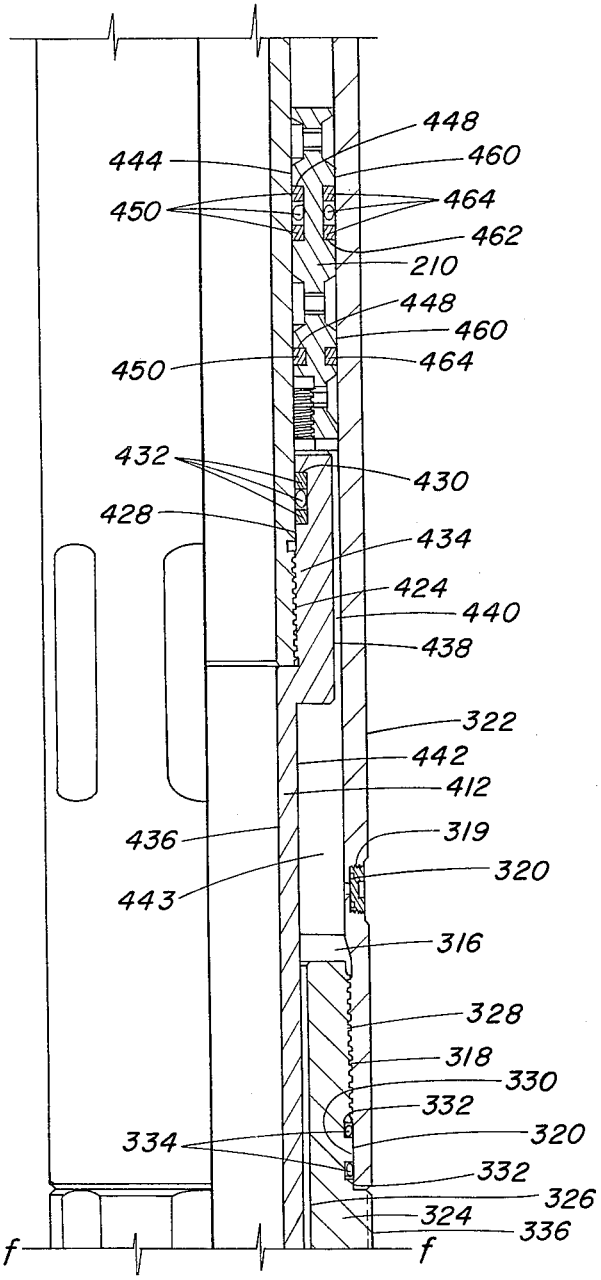
Figure 2F:
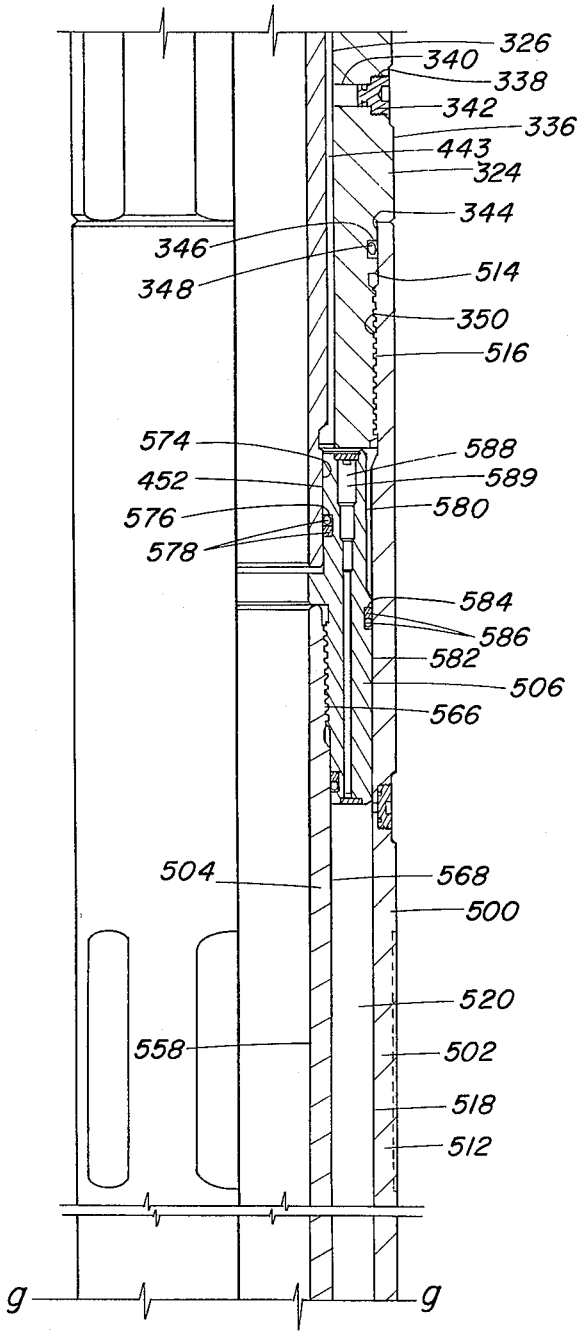
Figure 2G:
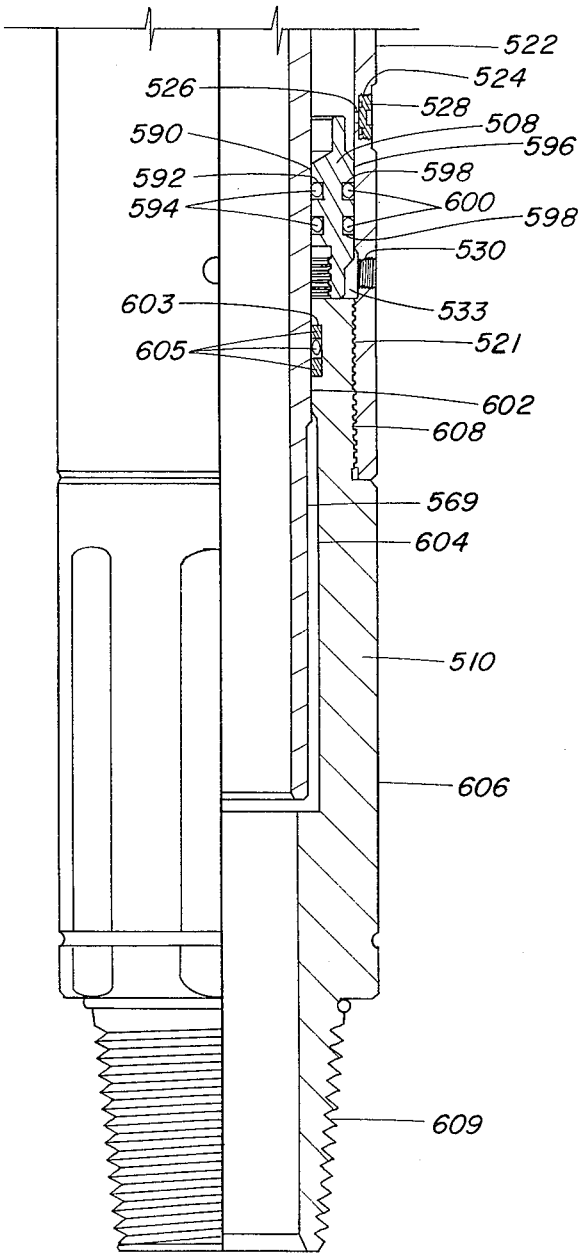

Referring to FIG. 1, the present invention is shown in a testing string for use in an offshore oil or gas well.

In FIG. 1, a floating work station is centered over a submerged oil or gas well located in the sea floor 2 having a bore hole 3 which extends from the sea floor 2 to a submerged formation 5 to be tested. The bore hole 3 is typically lined by a steel liner 4 cemented into place. A subsea conduit 6 extends from the deck 7 of the floating work station 1 into a wellhead installation 10. The floating work station 1 has a derrick 8 and a hoisting apparatus 9 for raising and lowering tools to drill, test, and complete the oil or gas well.

A testing string 14 is being lowered in the bore hole 3 of the oil or gas well. The testing string includes such tools as a slip joint 15 to compensate for the wave action of the floating work station 1 as the testing string is being lowered into place, a tester valve 16 and a circulation valve 17.

The slip joint 15 may be similar to that described in U.S. Pat. No. 3,354,950 to Hyde. The circulation valve 17 is preferably of the annulus pressure responsive type and may be that described in U.S. Pat. No. 3,850,250 to Holden et al, or may be a combination circulation valve and sample entrapment mechanism similar to those disclosed in U.S. Pat. No. 4,063,593 to Jessup or U.S. Pat. No. 4,064,937 to Barrington. The circulation valve 17 may also be the reclosable type as described in U.S. Pat. No. 4,113,012 to Evans et al.

A check valve assembly 20 as described in U.S. patent application Ser. No. 128,324 filed Mar. 7, 1980 which is annulus pressure responsive may be located in the testing string below the tester valve 16 of the present invention.

The tester valve 16, circulation valve 17 and check valve assembly 20 are operated by fluid annulus pressure exerted by a pump 11 on the deck of the floating work station 1. Pressure changes are transmitted by a pipe 12 to the well annulus 13 between the casing 4 and the testing string 14. Well annulus pressure is isolated from the formation 5 to be tested by a packer 18 set in the well casing 3 just above the formation 5. The packer 18 may be a Baker Oil Tool Model D packer, the Otis type W packer or the Halliburton Services EZ Drill® SV packer. Such packers are well known in the well testing art.

The testing string 14 includes a tubing seal assembly 19 at the lower end of the testing string which stabs through a passageway through the production packer 18 for forming a seal isolating the well annulus 13 above the packer 18 from an interior bore portion 1000 of the well immediately adjacent the formation 5 and below the packer 18.

A perforated tail piece 1005 or other production tube is located at the bottom end of the seal assembly 19 to allow formation fluids to flow from the formation 5 into the flow passage of the testing string 14. Formation fluid is admitted into wellbore portion 1004 through perforations 1003 provided in the casing 4 adjacent formation 5.

A formation test controlling the flow of fluid from the formation 5 through the flow channel in the testing string 14 by applying and releasing fluid annulus pressure to the well annulus 13 by pump 11 to operate tester valve 16, circulation valve assembly 17 and check valve means 20 and measuring of the pressure build-up curves and fluid temperature curves with appropriate pressure and temperature sensors in the testing string 14 is fully described in the aforementioned patents.

Referring to FIGS. *2a–2g* the tester valve 16 of the present invention is shown. The tester valve 16 comprises a valve section 30, power section 200, and isolation valve section 500.

The valve section 30 comprises an adapter 32, valve case 34, upper valve support 36, lower valve support 38, ball valve 40, ball valve actuation arms 42 and actuation sleeve 44.

The adapter 32 comprises a cylindrical elongated annular member having first bore 46, having first threaded bore 48 which is of smaller diameter than bore 46, having second bore 50 which is of smaller diameter than bore 48, having second threaded bore 56, having first cylindrical exterior portion 58 and having second cylindrical exterior portion 60 which is of smaller diameter than portion 58 and which contains annular seal cavity 62 having elastomeric seal means 64 therein.

The valve case 34 comprises a cylindrical elongated annular member having a first bore 66, having a plurality of internal lug means 68 circumferentially spaced about the interior of the valve case 34 near one end thereof, having second bore 70 which is of a smaller diameter than that of bore 66, having threaded bore 72 and having cylindrical exterior surface 74 thereon. The bore 66 sealingly engages second cylindrical exterior portion 60 of the adapter 32 when the case 34 is assembled therewith.

The upper valve support 36 comprises a cylindrical elongated annular member having first bore 76, having annular chamfered surface 78, having second bore 80 which is of larger diameter than bore 76, having first cylindrical exterior portion 82, having exterior threaded portion 84, having a plurality of lugs 86 circumferentially spaced about the exterior of the upper valve support 36 which are received between the plurality of internal lug means 68 circumferentially spaced about the interior of case 34, having annular shoulder 88 on the exterior thereof, having second cylindrical exterior portion 90, having annular recess 92 in the exterior thereof and having third exterior cylindrical portion 94. Received within second bore 80 of the upper valve support 36 is valve seat 96 having elastomeric seal 98 in annular recess 100 in the exterior thereof, having bore 102 therethrough and having spherical surface 104 on one end thereof.

The lower valve support 38 comprises an elongated cylindrical member having first bore 106, having second bore 108 of smaller diameter than bore 106, having third bore 110 of smaller diameter than bore 108, having first cylindrical exterior surface 112 having annular recess 114 therein and having second exterior cylindrical surface 116 of smaller diameter than surface 112. Received within first bore 106 of the lower valve support 38 is valve seat 118 having elastomeric seal 120 in annular recess 122 in the exterior thereof, having bore 124 therethrough and having spherical surface 126 on one end thereof.

The lower valve support 38 is secured to the upper valve support 36 by means of a plurality of c-clamp members (not shown) which extend around portions of the exterior surfaces of supports 38 and 36 having the ends 128 thereof received within annular recesses 92 and 114 of the supports 36 and 38 respectively.

Contained between upper 36 and lower 38 valve supports having spherical valve seats 102 and 118 respectively therein is ball valve 130 having a central bore (not shown) therethrough and a plurality of cylindrical recesses 132 in the exterior thereof.

To actuate the ball valve 130 a plurality of arms 42 connected actuation sleeve 44 are utilized.

Each arm 42 comprises an arcuate elongated member, which is located between the c-clamp members securing the upper 36 and lower 38 valve supports together, having a spherically shaped lug 134 thereon which mates in a cylindrical recess 132 of the ball valve 130, having lug 136 thereon and having lug 138 on one end thereof which mates with actuation sleeve 44.

The actuation sleeve 44 comprises a first elongated annular member 140 and second elongated annular member 142 which are releasably secured together. The first elongated annular member 140 is formed having first bore 144, having annular chamfered surface 146, having second bore 148 of a larger diameter than bore 144, having threaded bore 150, having cylindrical exterior surface 152 having annular recess 154 therein which receives lug 138 of each arm 42 therein, having second cylindrical exterior portion 156 of a larger diameter than portion 152 and having third cylindrical exterior portion 158 of smaller diameter than portion 152. The second annular elongated member 142 is formed having first bore 160 having annular recess 162 therein which, in turn, contains elastomeric seal means 164 therein, having second bore 166 of greater diameter than bore 160, having threaded exterior end portion 168 which engages threaded bore 150 of first annular elongated member 140, having first cylindrical exterior portion 170 of greater diameter than threaded end portion 168 and having second cylindrical exterior portion 172 having annular recess 174 therein which, in turn, contains elastomeric seal means 176 therein and sealingly engages second bore 70 of case 34.

The power section 200 of the tester valve 16 comprises power case 202, power mandrel 204, resilient ring assembly 206, fluid mandrel 208 and gas-fluid balancing seal 210.

The power case 202 comprises a plurality of members. The first member 212 comprises an elongated annular member having a first bore 214 having, in turn, annular recess 218 therein containing elastomeric seal means 220 therein, having a plurality of lugs 226 about the interior of the lower end of the first member 212, having first threaded exterior portion 228 which threadedly engages threaded bore 72 of the outer case 34 of the valve section 30, having first cylindrical exterior portion 230 having, in turn, annular recess 232 therein containing elastomeric seal means 234 therein, cylindrical exterior portion 230 having a greater diameter than portion 228, having second cylindrical exterior portion 236 of greater diameter than portion 230, having third cylindrical exterior portion 238 having, in turn, annular recess 240 therein containing elastomeric seal means 242 therein, portion 238 having a smaller diameter than portion 236 having exterior threaded end portion 244. The second member 246 of the power case 202 comprises an elongated annular member having first bore 246 on one end thereof which sealingly engages elastomeric seal means 242 of the first member 212, first threaded bore 248, a plurality of apertures 250 extending therethrough, having second bore 251 of smaller diameter than bore 248, having a third bore 252 of smaller diameter than second bore 251, having a fourth bore 253 of larger diameter than second bore 251, having second threaded bore 254 on the end thereof, and having cylindrical exterior portion 256. Due to the reduced diameter of third bore 252 with respect to second bore 251 and fourth bore 253 an annular lug 255 is formed in the interior of the second member 246. The third member 258 comprises an elongated annular member having first bore 260 having, in turn, first annular recess 262 therein containing elastomeric seal means 264 therein, second annular recess 266 therein, and third annular recess 268 therein containing elastomeric seal means 270 therein, having second bore 272 therein of smaller diameter than bore 260, having threaded bore 274 therein of larger diameter than bore 272, having third bore 276 therein of larger diameter than threaded bore 274, having first exterior threaded portion 282 which threadedly engages threaded bore 254 of second member 246, having first exterior cylindrical portion 284, having second exterior cylindrical portion 286 of greater diameter than portion 284, having third cylindrical exterior portion 288 of greater diameter than portion 286, having fourth cylindrical exterior portion 290 of smaller diameter than portion 288, having fifth cylindrical exterior portion 292 of smaller diameter than portion 290 and having second threaded exterior portion 294. The third member 258 is further formed having a plurality of longitudinal passageways 296 therein extending from end surface 298 to end surface 300. When the tester valve 16 is assembled, the third member 258 includes elastomeric seal means 302 and 394 on cylindrical exterior surfaces 284 and 292 respectively sealingly engaging portions of second member 246 and fourth member 306. The fourth member 306 comprises an elongated annular member having first bore 308 which engages elastomeric seal means 304, having first threaded bore 310 of smaller diameter than bore 308 engaging second threaded exterior portion 292, having first annular chamfered surface 312, having second bore 314 of smaller diameter than 310, having second annular chamfered surface 316, having second threaded bore 318 of larger diameter than bore 314, having bore 320 of larger diameter than bore 318 and having cylindrical exterior surface 322. Fourth member 306 also includes a plurality of threaded apertures 319 containing a plurality of threaded plugs 321 therein. The fifth member 324 comprises an elongated annular member having bore 326 therethrough, having first threaded exterior portion 328 which mates with second threaded bore 318 of third member 258, having first cylindrical exterior portion 330 of greater diameter than portion 328, having, in turn, annular recess 332 therein containing annular elastomeric seal means 334 therein, having second cylindrical exterior portion 336 of greater diameter than portion 330, having, in turn, a plurality of threaded apertures 338, ports 340 and plugs 342 therein, having third cylindrical exterior portion 344 of smaller diameter than portion 336 having, in turn, annular recess 346 therein containing elastomeric seal means 348 therein and having second threaded exterior portion 350 of smaller diameter than portion 344.

The power mandrel 204 comprises a first member 352, and second member 354 and cap 372. The first member 352 comprises an elongated annular member having a bore 356, having a first cylindrical exterior portion 394, having 396 thereon which mate with lugs 226, having a second cylindrical exterior portion 398, a first threaded exterior portion 400 and second threaded exterior portion 402.

The second member 354 comprises an elongated annular member having a first bore 368 having, in turn, annular cavity 370 therein containing elastomeric seal means 372, threaded bore 374 which mates with second threaded exterior portion 366 of first member 352, second bore 376 which is of a diameter substantially the same as bore 356 of first member 352, first exterior cylindrical portion 378 which is of smaller diameter than either first threaded bore 248 or second bore 251 of second member 246 thereby forming annular cavity 379, second exterior cylindrical portion 380 of substantially the same diameter as bore 251 having, in turn, annular cavity 381 therein containing elastomeric seal means 382, third exterior cylindrical portion 384 of substantially smaller diameter than bore 251 thereby forming annular cavity 385, fourth exterior cylindrical portion 386 of slightly larger diameter than portion 384 having, in turn, annular chamfered surface 387 on one end thereof, fifth exterior cylindrical surface 390 of slightly smaller diameter than third bore 252 having, in turn, annular chamfered surface 391 on one end thereof while annular chamfered surface 392 is contained on the other end thereof, sixth exterior cylindrical surface 394 of smaller diameter than fifth exterior portion 390, and seventh exterior cylindrical surface 396 being substantially the same diameter as first bore 260 of third member 258 to sealingly engage elastomeric seal means 264 therein.

The resilient ring assembly 206 comprising resilient spring ring 404, anvil 406, and spiral wound spring 408 is installed in the power section 200 to secure the power mandrel 204 in position within the power section 200 and positively control the full opening and closing of the ball valve 40 such that the valve 40 is prevented from only partially opening or closing. The resilient spring ring 404, a split cylindrical ring spring, has the upper end thereof abutting the lower surface of annular lug 255 of the power case 202 while the lower end thereof abuts the upper end of anvil 406. The lower end of anvil 406 abuts the end surface 300 of the third member 258 of the power case 202. The spiral wound spring 408 is contained within cavity 385 and has the lower end thereof abutting the upper surface of annular lug 255 of the power case 202 while the upper end thereof abuts shoulder 383 of the second member 354. If desired, the spiral wound spring 408 may be deleted, although the valve 40 may exhibit limited movement without spring 408.

The cap 800 comprises an annular cylindrical member having interior annular chamfered surface 802, cylindrical bore 804 which is substantially the same diameter as bore 356 of first member 354, threaded bore 806 which mates with first exterior threaded portion 364 of first member 354, annular chamfered exterior surface 808 which mates with annular chamfered surface 146 of member 140, and cylindrical exterior portion 810 which is of smaller diameter than second bore 148 of member 140.

Secured to threaded bore 274 of third member 258 is fluid mandrel 208. The fluid mandrel 208 comprises first member 410 and second member 412. The first member 410 comprises an elongated annular member having a bore 414 therethrough, having first threaded exterior portion 416 which threadedly engages threaded bore 274 of third member 258 of case 202, having first cylindrical exterior portion 418 which sealingly engages elastomeric seal means 280, having annular shoulder 420 which sealingly engages elastomeric seal means 280, having second cylindrical exterior portion 422 which is substantilly smaller in diameter than second bore 314 of fourth member 306 of case 202 thereby creating an annular chamber 426 therebetween and having second exterior threaded portion 424. The second member 412 comprises an elongated annular member having first bore 428 having, in turn, annular channel 430 therein containing elastomeric seal means 432 therein sealingly engaging portion 422 of first member 410, having threaded bore 434 which threadedly engages second exterior threaded portion 424 of first member 410, having second bore 436 which is substantially equal in diameter as bore 414 of first member 410, having first cylindrical exterior portion 438 which is of smaller diameter than bore 314 of fourth member 306 of case 202 thereby creating annulus 440 therebetween, and having second cylindrical exterior portion 442 having a diameter slightly smaller than bore 326 of fifth member 324 to permit the passage of second member 412 therethrough.

The gas-filled balancing seal 210 comprises an elongated annular member having first bore 444 having, in turn, annular recess 448 therein containing elastomeric seal means 450 therein sealingly engaging second cylindrical exterior portion 422 of first member 410 of fluid mandrel 208, having threaded bore 458, and having first cylindrical portion 460 having, in turn, annular recess 462 therein containing elastomeric seal means 464 therein sealingly engaging second bore 314 of fourth member 306 of case 202.

The isolation valve section 500 comprises isolation case 502, isolation valve mandrel 504, metering cartridge 506, fluid balancing piston 508 and adapter 510.

The isolation case 502 comprises a member 512 having bore 514 sealingly engaging elastomeric seal means 348 of case 202, having first threaded bore 516 which threadedly engages threaded exterior portion 350 of case 202, having bore 518 which is of smaller diameter than bore 514 but of substantially larger diameter than cylindrical exterior portion 442 of fluid mandrel 208 thereby forming an annular space 520 in which metering cartridge 506 is contained, having second threaded bore 521 and having cylindrical exterior portion 522 having threaded apertures 524, ports 526 and threaded plugs 528 therein, and threaded bores 530.

The isolation mandrel 504 comprises an elongated annular member having a bore 558 being substantially the same diameter as bore 436 of fluid mandrel 208, having first threaded cylindrical exterior portion 566 having first cylindrical exterior portion 568 of substantially smaller diameter than bore 518 of isolation case 502 thereby forming an annular cavity 520 therebetween and having second cylindrical exterior portion 570 which extends into adapter 510.

The metering cartridge 506 comprises an elongated annular member having a bore 574 therethrough having, in turn, annular recess 576 therein containing elastomeric seal means 578 therein sealing engaging portion 452 of fluid mandrel 208, having threaded bore 579, which mates with first threaded portion 566 having first cylindrical exterior portion 580, having second cylindrical exterior portion 582 having, in turn, annular recess 584 therein containing elastomeric seal means 586 therein sealingly engaging bore 518 of isolation case 502, and having a plurality of longitudinal apertures or passageways 588 extending longitudinally therethrough, each passage having, in turn, a fluid resistor 589 therein to allow fluid flow from across the metering cartridge 506. Any suitable fluid resistor 589 may be utilized in the longitudinal apertures or passageways 588 such as the fluid resistors described in U.S. Pat. No. 3,323,550. Alternately, conventional relief valves may be utilized rather than the fluid resistors described in U.S. Pat. No. 3,323,550 or in combination therewith.

The fluid balancing piston 508 comprises an elongated annular member having a bore 590 having, in turn, annular recesses 592 therein containing elastomeric seal means 594 therein sealingly engaging first cylindrical exterior portion 568 of isolation mandrel 504 and having cylindrical exterior portion 596 having, in turn, annular recesses 598 therein containing elastomeric seal means 600 therein sealingly engaging bore 518 of isolation case 502.

The adapter 510 comprises an annular member having first bore 602 having, in turn, annular recess 603 therein containing elastomeric seal means 605, having bore 604 substantially larger than the exterior portion 569 of isolation mandrel 504, having cylindrical exterior portion 606 substantially the same diameter as cylindrical exterior portion 522 of isolation case 502, having upper threaded exterior portion 608 and lower threaded exterior portion 609.

It should be understood that the valve case 34, power case 202 and isolation case 502 are formed having substantially the same dimension for the exterior surfaces thereof to provide an assembled tester valve 16 having a substantially uninterrupted outer surface. Similarly, adapter 32, the upper valve support 36, lower valve support 38, power mandrel 204, power case 202, fluid mandrel 208, isolation mandrel 504 and adapter 510 are all formed having the bores therethrough substantially the same dimension to provide a substantially uninterrupted flow path through the tester valve 16.

OPERATION OF THE TESTER VALVE

When the tester valve 16 is assembled, chamber 426 and chamber 403 which communicates therewith via passages 296 are filled with inert gas, usually nitrogen, a resilient means, through ports (not shown) in the case of the tester valve 16, the amount of pressure of the inert gas being determined by the hydrostatic pressure and temperature of the formation at which the tester valve is to be utilized in a wellbore 3. At the same time chambers 520 and 443 are filled with suitable oil.

When the testing string 10 is inserted and lowered into the wellbore 3, the ball valve 130 is in its closed position. The packer 18 follows fluid to pass into the wellbore during the descent of the testing string 10.

During the lowering process, the hydrostatic pressure of the fluid in the annulus 16 and the interior bore of the tester valve 16 will increase. At some point, the annulus pressure of the fluid will exceed the pressure of the inert gas in chamber 426, and the fluid balancing piston 508 will begin to move upward due to the pressure differential thereacross from annulus fluid flowing through ports 530 in isolation case 502 and through chamber 533 to act on the piston 508. When the fluid balancing piston 508 moves upwardly in oil filled chamber 572, the oil flows through the metering cartridge 506 having fluid resistors 589 therein, through chamber 443 and acts on gas-fluid balancing seal 210 causing the seal 210 to compress the inert gas in chambers 426 and 403 until the inert gas is at the same pressure as the fluid in the annulus surrounding the tester valve 16. In this manner, the initial pressure given to the inert gas in chambers 426 and 403 will be supplemented to automatically adjust for the increasing hydrostatic fluid pressure in the annulus, and other changes in the environment due to increased temperature.

When the packer 18 is set to seal off the formation 5 to be tested and the tubing seal assembly 19 sealingly engages the packer 18, the pressure of the fluid in the interior bore of the tester valve 16 then being independent from annulus fluid pressure since there is no communication between them. To open the ball valve 130 to allow fluid to form through the tester valve 16 from the formation 5 to be tested the pressure of the fluid in annulus 13 is increased thereby causing the annulus fluid pressure to be transmitted through ports 250 and act across the annular area between second cylindrical exterior surface 366 and bore 214 of power case 202 and causing annulus fluid pressure to be transmitted through ports 530 and act across the annular area between second cylindrical exterior surface 568 of isolation mandrel 504 and bore 518 of the first member 512 of the isolation case 502 in which the fluid balancing piston 508 is slidably retained in sealing engagement therewith. Since a pressure differential exist with the application of the annulus fluid pressure between the annular area between second cylindrical exterior surface 366 and bore 214 of power case 202 and chambers 426 and 403 due to the restricted fluid flow through fluid resistors 589 in metering cartridge 506, the power mandrel 204 is subjected to a force tending to cause the power mandrel 204 to move downwardly within the power case 202. When the force from the fluid pressure in the annulus 13 surrounding the tester valve 16 reaches a predetermined level, the force acting on power mandrel 204 is sufficient to cause resilient spring ring 404, which is retaining power mandrel 204 in a position wherein the ball valve 130 is closed, to expand thereby allowing the power mandrel 204 to suddenly move downwardly within power case 202 thereby completely opening the ball valve 130 in one continuous uninterrupted movement.

When the power mandrel 204 moves downwardly in power case 202, cap 800 of the power mandrel 204 engages second member 142 of the actuation sleeve 44 thereby causing the actuation sleeve 44 to move downwardly within valve case 34 which, in turn, causes ball valve arms 42 to rotate the ball valve 130 within the upper 36 and lower 38 valve supports to its open position. The movement of the power mandrel 204 in the power case 202 ceases when the end of second annular elongated member 142 abuts end surface 300 of second member 258.

Concurrently with the movement of the power mandrel 204, the increased fluid pressure in the annulus 13 of the wellbore causes fluid balancing piston 508 to move upwardly within chamber 572 thereby causing oil to flow through metering cartridge 506, through chamber 443 causing, in turn, the gas-fluid balancing seal 210 to move upwardly in chamber 426 thereby compressing the inert gas therein to an increased pressure level thereby providing an inversed resilient means in the power section operating on the power mandrel.

When the tester valve 16 has the ball valve 130 open therein, if cold fluids are pumped therethrough, the inert gas in chambers 403 and 406 will be cooled thereby contracting in volume. When the inert gas contracts in volume displacement, since the fluid balancing piston 508 and gas balancing seal 210 are still subjected to the pressure of the fluid in the annulus 13 of the wellbore 3, the inert gas is still maintained under annulus fluid pressure.

To close the ball valve 130 the fluid pressure in the annulus 13 of the wellbore 3 surrounding the tester valve 16 is reduced to is hydrostatic fluid pressure level thereby allowing the compressed inert gas in chambers 403 and 426 to expand and to expand suddenly as before the resilient ring assembly 206 and moving gas balancing seal 210 and fluid balancing piston 508 downwardly in the tester valve 16 while the expanding compressed gas moves the power mandrel 204 upwardly in the tester valve 16 closing the ball valve 130. When the compressed inert gas in chambers 403 and 426 expands, since the metering cartridge 506 has fluid resistors 589 therein, the expansion of the inert gas in chambers 405 and 426 occurs slowly due to the slow fluid movement from chamber 443 through metering cartridge 506 to chambers 568 and 572 thereby causing the inert gas to be compressed to a higher pressure level for a longer time period than if metering cartridge 506 were not in the tester valve 16. In the event conventional pressure relief valves are used rather than fluid resistors 589 or in combination therewith in metering cartridge 506, the pressure relief valves will maintain a pressure differential between the annulus 13 and chambers 426 and 403 thereby preventing the compressed gas from returning to its original pressure level in chambers 426 and 403.

If the metering cartridge having fluid resistors 589 therein were not present in the tester valve to control the rate at which fluid flows from chambers 572, 586 and 443 thereby controlling the flow of inert gas from chambers 426 and 403, if large volumes of cold fluids are pumped through tester valve 16 thereby causing the inert gas in chambers 426 and 403 to contract, and if the chambers 426 and 403 are initially filled with inert gas at a pressure level which is correlated with the hydrostatic fluid pressure level and temperature of the formation at which the tester valve 16 is to be utilized, in many instances, the ball valve 130 will not close when the fluid pressure in the annulus 13 of the wellbore 3 returns to the normal hydrostatic fluid pressure level because the compressed inert gas in chambers 403 and 426 will not be compressed to a sufficient pressure level to exert sufficent force on the power mandrel 204 to cause the closing of the ball valve 130. If this condition occurs, the ball valve 130 will only be closed when the formation fluids warm the compressed inert gas in chambers 403 and 426 thereby causing the gas to expand and move power mandrel 204 upwardly thereby closing the valve 130. Since this warming of the compressed inert gas in chambers 403 and 426 can require a lengthy period of time, the flow from the formation 5 cannot be controlled by the tester valve 16 which is an undesirable condition.

Thus, it is readily apparent that the inclusion of a metering cartridge 506 to control the flow of fluid between chambers 572 and 443 and, consequently, the flow of compressed inert gas between chambers 426 and 403 clearly makes the tester valve 16 of the present invention insensitive to environmental temperature gradients during use.

Having thus described my invention, I claim:

1. A valve for use in a well testing string located in a wellbore and having a packer arranged for selectively sealing the wellbore isolating that portion of the wellbore above the packer from that portion of the wellbore below the packer to allow the production of fluids from that portion of the wellbore below the packer through said valve in the testing string as well as the introduction of fluids into that portion of the wellbore below the packer through said valve in the testing string, said valve being responsive to changes in the pressure of the fluid in the annulus between the wellbore and the well testing string in that portion of the wellbore above the packer when the packer sealingly engages the wellbore, said valve comprising:

valve section means having a valve means therein in a closed position to prevent the flow of fluid through the well testing string, the valve means being responsive to changes in the pressure of the fluid in the annulus to open the valve means to allow the flow of fluid through the well testing string;

power section means responsive to changes in the pressure of the fluid in the annulus, the power section means having first means therein adapted to move the valve means of the valve section means to the open position and having resilient means therein adapted to return the valve means of the valve section means to the closed position from the open position in response to a change in the pressure of the fluid in the annulus, wherein the power section means comprises:

power case means releasably secured to the valve section means and the isolation valve means;

power mandrel means slidably disposed within the power case means adapted to engage a portion of the valve section means to close the valve means therein;

fluid mandrel means secured within the power case means;

gas-fluid balancing seal means slidably disposed on the fluid mandrel means within the power case means; and resilient ring assembly means retained within the power case means releasably securing the power mandrel means in either a first closed position or second open position within the power case means; and isolation valve means for being continuously responsive substantially without interruption during such time as said valve is located in said wellbore to changes in the pressure of the fluid in the annulus adapted to maintain the resilient means of the power section means at a level of force sufficient to close the valve means of the valve section means regardless of the hydrostatic pressure and temperature of the fluid in the annulus and the pressure and temperature of the fluid in said valve in the testing string.

2. The valve of claim 1 wherein the valve section means comprises:

adapter means for securing said valve to the testing string;

valve case means secured to the adapter means;

upper valve support means secured within the valve case means;

lower valve support means secured within the valve case means;

ball valve means movably retained between the upper valve support means and the lower valve support means;

ball valve actuation arm means movably secured to the ball valve means to rotate the ball valve means within the upper valve support means and lower valve support means; and actuation sleeve means engaging the ball valve actuation arm means to move the arm means in response to changes of the pressure of the fluid in the annulus.

3. The valve of claim 1 wherein the resilient ring assembly means comprises:

resilient spring ring means;

anvil means; and spiral wound spring means.

4. The valve of claim 1 wherein the isolation valve means comprises:

isolation case means releasably secured to the power section means;

isolation mandrel means secured within the isolation case means;

metering cartridge means retained within the isolation case means on the exterior of the isolation mandrel means;

fluid balancing piston means slidably disposed on the isolation mandrel means within the isolation case means; and adapter means releasably secured to the isolation case means for releasably securing said valve means to the testing string.

5. The valve of claim 1 wherein the resilient means in the power section means comprises inert compressible gas.

6. The valve of claim 5 wherein the inert compressible gas comprises nitrogen.

7. A valve for use in a well testing string located in a wellbore and having a packer arranged for selectively sealing the wellbore isolating that portion of the wellbore above the packer from that portion of the wellbore below the packer to allow the production of fluids from that portion of the wellbore below the packer through said valve in the testing string as well as the introduction of fluids into that portion of the wellbore below the packer through said valve in the testing string, said valve being responsive to changes in the pressure of the fluid in the annulus between the wellbore and the well testing string in that portion of the wellbore above the packer when the packer sealingly engages the wellbore, said valve comprising:

valve section means having a valve means therein in a closed position to prevent the flow of fluid through the well testing string, the valve means being responsive to changes in the pressure of the fluid in the annulus to open the valve means to allow the flow of fluid through the well testing string, the valve section means including:

adapter means for securing said valve to the testing string;

valve case means secured to the adapter means;

upper valve support means secured within the valve case means;

lower valve support means secured within the valve case means;

ball valve means movably retained between the upper valve support means and the lower valve support means;

ball valve actuation arm means movably secured to the ball valve means to rotate the ball valve means within the upper valve support means and lower valve support means; and actuation sleeve means engaging the ball valve actuation arm means to move the arm means in response to changes of the pressure of the fluid in the annulus;

power section means responsive to changes in the pressure of the fluid in the annulus, the power section means having first means therein adapted to move the valve means of the valve section means to the open position and having resilient means therein adapted to return the valve means of the valve section means to the closed position from the open position in response to a change in the pressure of the fluid in the annulus, the power section means including:

power case means releasably secured to the valve case means;

power mandrel means slidably disposed within the power case means adapted to engage a portion of the valve section means to close the valve means therein;

fluid mandrel means secured within the power case means;

gas-fluid balancing seal means slidably disposed on the fluid mandrel means within the power case means; and resilient ring assembly means retained within case means releasably securing the power mandrel means in either a first closed position or second open position until the pressure of the fluid in the annulus reaches a predetermined level; and isolation valve means for being continuously responsive substantially without interruption during such time as said valve is located in said wellbore to changes in the pressure of the fluid in the annulus adapted to maintain the resilient means of the power section means at a level of force sufficient to close the valve means of the valve section means regardless of the hydrostatic pressure and temperature of the fluid in the annulus and the pressure and temperature of the fluid in said valve in the testing string, the isolation valve means including:

isolation case means releasably secured to the power case means;

isolation mandrel means secured within the isolation case means;

metering cartridge means retained within the isolation case means on the exterior of the isolation mandrel means;

fluid balancing piston means slidably disposed on the isolation mandrel means within the isolation case means; and adapter means releasably secured to the isolation case means for releasably securing said valve means to the testing string.

8. The valve of claim 7 wherein the resilient means in the power section means comprises inert compressible gas.

9. The valve of claim 7 wherein the metering cartridge means contains fluid resistor means located therein.

10. The valve of claim 7 wherein the resilient ring assembly means comprises:

resilient spring ring means;

anvil means; and spiral wound spring means.

11. A valve for use in a well testing string located in a wellbore and having a packer arranged for selectively sealing the wellbore isolating that portion of the wellbore above the packer from that portion of the wellbore below the packer to allow the production of fluids from that portion of the wellbore below the packer through said valve in the testing string as well as the introduction of fluids into that portion of the wellbore below the packer through said valve in the testing string, said valve being responsive to changes in the pressure of the fluid in the annulus between the wellbore and the well testing string in that portion of the wellbore above the packer when the packer sealingly engages the wellbore, said valve comprising:

valve section means having a valve means therein in a closed position to prevent the flow of fluid through the well testing string, the valve means being responsive to changes in the pressure of the fluid in the annulus to open the valve means to allow the flow of fluid through the well testing string, the valve section means including:

annular adapter means for securing said valve to the testing string;

annular valve case means secured to the annular adapter means;

annular upper valve support means secured within the annular valve case means;

annular lower valve support means secured within the annular valve case means;

ball valve means movably retained between the annular upper valve support means and the annular lower valve support means;

ball valve actuation arm means movably secured to the ball valve means to rotate the ball valve means within the annular upper valve support means and annular lower valve support means; and annular actuation sleeve means engaging the ball valve actuation arm means to move the arm means in response to changes of the pressure of the fluid in the annulus;

power section means responsive to changes in the pressure of the fluid in the annulus, the power section means having first means therein adapted to move the valve means of the valve section means to the open position and having resilient means therein adapted to bias the valve means of the valve section means towards the closed position from the open position in response to a change in the pressure of the fluid in the annulus, the power section means including:

annular power case means releasably secured to the annular valve case means;

annular power mandrel means slidably disposed within the annular power case means and a portion of the annular valve case means adapted to engage a portion of the valve section means to close the valve means therein and having a portion of the exterior thereof of substantially smaller diameter than the diameter of the interior of the annular power case means thereby forming annular power mandrel chamber means therewith;

annular fluid mandrel means secured within the annular power case means forming annular fluid mandrel chamber means with respect to the annular power case means;

gas-fluid balancing seal means slidably disposed on the annular fluid mandrel means within the power case means in a portion of the annular fluid mandrel chamber means between the annular power case means and annular fluid mandrel means, the annular power mandrel chamber means and annular fluid mandrel chamber means having fluid communication therebetween;

resilient ring assembly means retained within the power case means releasably securing the means in either a first closed position or second open position within the power case means until the pressure of the fluid in the annulus reaches a predetermined level, wherein the resilient ring assembly means comprises:

resilient spring ring means;

anvil means; and spiral wound spring means;

compressible gas means located in the annular power mandrel chamber means and a portion of the annular fluid mandrel chamber means; and power fluid means located in a portion of the annular fluid mandrel chamber means being separated from the compressible gas means therein by the gas-fluid balancing seal means;

isolation valve means for being continuously responsive substantially without interruption during such time as said valve is located in said wellbore to changes in the pressure of the fluid in the annulus adapted to maintain the resilient means of the power section means at a level of force sufficient to close the valve means of the valve section means regardless of the hydrostatic pressure and temperature of the fluid in the annulus and the pressure and temperature of the fluid in said valve in the testing string, the isolation valve means including:

annular isolation case means releasably secured to the annular power case means;

annular isolation mandrel means having one end thereof sealingly secured within the annular isolation case means, the annular isolation mandrel means forming annular isolation mandrel chamber means with the isolation case means and sealingly engaging the annular fluid mandrel means, the annular isolation mandrel chamber means communicating with the annular fluid mandrel chamber means;

annular metering cartridge means retained within the annular isolation case means on the exterior of the annular isolation mandrel means in a portion of the annular isolation mandrel chamber means;

annular fluid balancing piston means slidably disposed on the annular isolation mandrel means within a portion of the annular isolation mandrel chamber means;

isolation fluid means located in a portion of the annular isolation chamber means on one side of the annular fluid balancing piston means communicating with the power fluid means of the power section means; and adapter means releasably secured to the annular isolation case means for releasably securing said valve means to the testing string.

* * * * *

UNITED STATES PATENT AND TRADEMARK OFFICE

CERTIFICATE OF CORRECTION

PATENT NO. : 4,429,748

DATED : Feb. 7, 1984

INVENTOR(S) : Harold K. Beck

It is certified that error appears in the above-identified patent and that said Letters Patent is hereby corrected as shown below:

In column 1, line 7, following the date "Nov. 5, 1980" insert --, now U.S. Patent No. 4,422,506--.
In column 3, line 63, delete the word [thereby] and insert therefor --thereof--.
In column 9, line 14, delete the word [substantilly] and insert therefor --substantially--.
In column 9, line 33, delete the word [gas-filled] and insert therefor --gas-fluid--.
In column 10, line 61, delete the word [follows] and insert therefor --allows--.
In column 12, line 41, delete the numeral [586] and insert therefor --568--.

Signed and Sealed this

*Seventh* Day of *August 1984*

[SEAL]

*Attest:*

GERALD J. MOSSINGHOFF

*Attesting Officer*

*Commissioner of Patents and Trademarks*